US009318852B2

(12) United States Patent
Luo et al.

(10) Patent No.: US 9,318,852 B2
(45) Date of Patent: Apr. 19, 2016

(54) DC CONNECTOR WITH A VOLTAGE-STABILIZING FUNCTION

(71) Applicant: AcBel Electronic (Dong Guan) Co., Ltd., Dong Guan, Guand Dong Province (CN)

(72) Inventors: Bin Luo, Dong Guan (CN); Wei-Qiang Li, Dong Guan (CN)

(73) Assignee: AcBel Electronic (Dong Guan) Co., Ltd., Dong Guan, Guand Dong Province (CN)

( * ) Notice: Subject to any disclaimer, the term of this patent is extended or adjusted under 35 U.S.C. 154(b) by 0 days.

(21) Appl. No.: 14/499,748

(22) Filed: Sep. 29, 2014

(65) Prior Publication Data

US 2015/0118910 A1 Apr. 30, 2015

(30) Foreign Application Priority Data

Oct. 28, 2013 (CN) ..... 2013 2 0668783 U

(51) Int. Cl.

| | |
|---|---|
| ***H01R 13/66*** | (2006.01) |
| ***H01R 24/48*** | (2011.01) |
| *H01R 13/719* | (2011.01) |
| *H01R 103/00* | (2006.01) |

(52) U.S. Cl.

CPC ..... *H01R 13/6625* (2013.01); *H01R 24/48* (2013.01); *H01R 13/719* (2013.01); *H01R 2103/00* (2013.01)

(58) Field of Classification Search

CPC ..... H01R 13/6625

See application file for complete search history.

(56) References Cited

U.S. PATENT DOCUMENTS

| | | | | | |
|---|---|---|---|---|---|
| 4,229,714 | A * | 10/1980 | Yu | H01R 24/42 | 333/12 |
| 4,575,691 | A * | 3/1986 | Capek | H01P 1/202 | 333/12 |
| 4,884,982 | A * | 12/1989 | Fleming | H01R 24/48 | 333/185 |
| 4,934,960 | A * | 6/1990 | Capp | H01R 13/6625 | 333/185 |
| 5,062,811 | A * | 11/1991 | Hackman | H01R 24/50 | 439/581 |
| 5,145,412 | A * | 9/1992 | Tan | H01R 13/7195 | 333/185 |
| 5,192,230 | A * | 3/1993 | Gabany | H01R 13/6625 | 333/12 |
| 5,221,216 | A * | 6/1993 | Gabany | H01R 24/50 | 333/185 |

(Continued)

*Primary Examiner* — Ross Gushi

(74) *Attorney, Agent, or Firm* — patenttm.us

(57) ABSTRACT

A DC connector with a voltage-stabilizing function has a tube and a wire connected with a noise-resistant filter between the tube and the wire. The tube has an upper cap and a lower opening. The lower opening has an internal terminal for electrical connection when the tube is inserted into a corresponding socket. The upper cap of the tube has a first connecting part. An outer wall of the tube near the upper ring has a second connecting part. The filter has two electrode terminals electrically connecting to the first and second connecting parts, respectively. The first and second connecting parts also electrically connect to the anode and cathode of the wires. Therefore, when an electrical signal is sent from the wire to the first connecting part, the filter provides the functions of filtering noises for stabilizing voltage.

10 Claims, 3 Drawing Sheets

(56) References Cited

U.S. PATENT DOCUMENTS 5,340,325 A * 8/1994 Pai ..... H01R 24/42 439/188
5,478,258 A * 12/1995 Wang ..... H01R 24/50 439/581
5,557,068 A * 9/1996 Chung ..... H01R 13/6625 174/59
5,613,880 A * 3/1997 Wang ..... H01R 24/42 439/541.5
5,730,621 A * 3/1998 Wang ..... H01R 24/50 439/541.5
5,882,228 A * 3/1999 Kobler ..... H01R 13/7195 439/620.05
6,380,826 B1 * 4/2002 Palinkas ..... H01R 24/42 333/175
7,223,916 B2 * 5/2007 Kawamura ..... H01R 9/0518 174/84 C
7,632,122 B2 * 12/2009 Pesant ..... H01R 24/44 439/188
7,670,182 B2 * 3/2010 Morikawa ..... H01R 9/0518 439/620.03
7,887,377 B1 * 2/2011 Wallace ..... H01R 24/562 439/669
8,624,689 B2 * 1/2014 Hsieh ..... H01R 13/6608 333/185
2007/0093080 A1 * 4/2007 MacKillop ..... H01R 13/719 439/13
2007/0229200 A1 * 10/2007 Lee ..... H01P 1/227 333/81 A
2011/0028034 A1 * 2/2011 Morikawa ..... H01R 9/0518 439/578
2013/0100571 A1 * 4/2013 Alkan ..... H02H 9/044 361/118
2014/0177122 A1 * 6/2014 Kauffman ..... H01R 24/48 361/118
2015/0118910 A1 * 4/2015 Luo ..... H01R 13/6625 439/620.09

* cited by examiner

DC CONNECTOR WITH A VOLTAGE-STABILIZING FUNCTION

BACKGROUND OF THE INVENTION

1. Field of the Invention

The invention relates to a DC connector, and in particular to a DC connector that can output stabilized signals when supplying power to an electronic device.

2. Description of Related Art

Most electronic devices on the market provide a socket in order to connect to a power supply via a wire with the corresponding connector. The power supply connects to the socket of the electronic device via the connector and inputs the power, so that the electronic device can function normally.

Technology advancements push forward the development of electronic devices. Most electronic devices have fairly complicated circuits, including transmission circuits between different circuit modules and the power circuits for supplying voltages. The power circuit, in particular, provides power for the modules to operate normally. Currently, the power requirement of electronic devices increases with time. Since the electronic devices have an increasing number of complicated circuit modules, the stability in power supply is extremely important as far as safety is concerned. When the power supply connects to an electronic device via a wire, the working voltage received by the electronic device is often unstable due to signal interference in a long wire or when the electronic device is also connected with various other circuits. Under the environment of high electromagnetic noises, signal transmission can be easily affected, resulting in signal interruption or noises. Such effects will result in malfunction or shorten the lifetime of the electronic device.

To resolve the above-mentioned problems, manufacturers often add a filter circuit on the printed circuit board (PCB) to remove the noises. Besides, the wire connecting to the external power supply is replaced with a filtering wire, so that the signal is not interfered by the environment during the transmission. This filtering method is adopted to achieve voltage stabilization. However, using the above-mentioned mechanism costs higher to remove the noises and interference, and therefore a more cost-effective solution is desirable.

SUMMARY OF THE INVENTION

An objective of the invention is to provide a DC connector with a voltage-stabilizing function, so that voltage stabilization is achieved at a lower cost with the help of a filtering, noise-resistant, and interference-resistant connector.

The DC connector with the voltage-stabilizing function comprises:

a tube, which is a circular cylinder with an upper cap and a lower opening, the upper cap of the tube being provided with a first connecting part and an outer wall of the tube near the upper cap being provided with a second connecting part;

a filter, which has two electrode terminals electrically connecting to the first connecting part and the second connecting part, respectively; and an internal terminal, which is disposed inside the lower opening of the tube along an axial direction of the tube.

Accordingly, the first connecting part and the second connecting part of the tube are electrically connected to the filter. When the tube outputs a power signal, the connected filter filters the power signal and removes noises therein. Therefore, the invention can indeed effectively stabilize the output voltage and lower the production cost at the same time.

DETAILED DESCRIPTION OF THE PREFERRED EMBODIMENT

Figure 1:
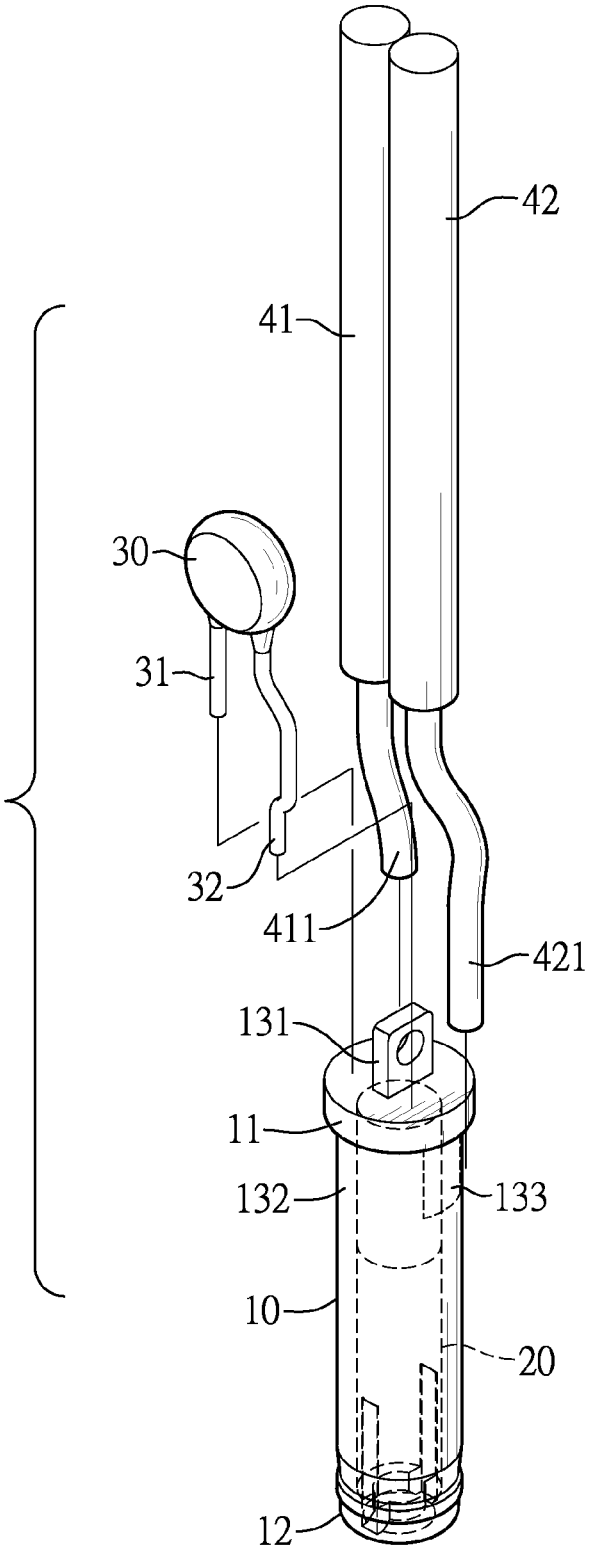
FIG. 1 is an exploded view of the invention.
Figure 2:
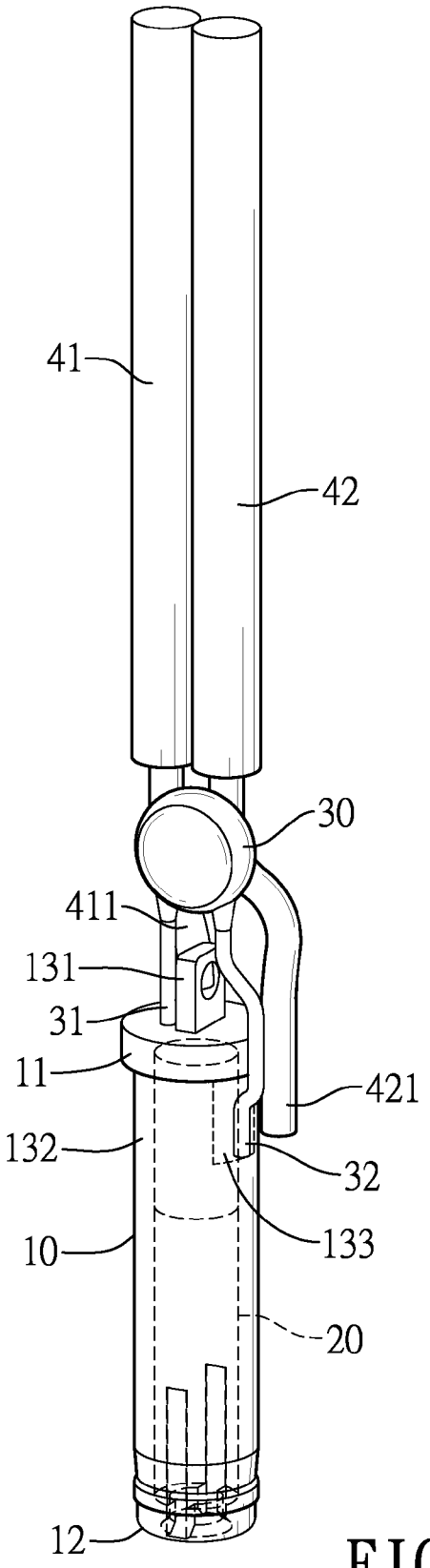
FIG. 2 shows an operational view of the preferred embodiment.

Please refer to FIGS. 1 and 2 for a preferred embodiment of the invention. As shown in the drawings, a DC connector with a voltage-stabilizing function comprises a tube 10, an internal terminal 20, and a filter 30. This embodiment further includes a first wire 41 and a second wire 42 disposed in parallel.

The tube 10 is a circular cylinder having an outer wall being electroplated. The tube 10 has an upper end and a lower end, with the upper end formed with an upper cap 11 and the lower end formed with a lower opening 12. The internal terminal 20 is inserted along an axial direction of the lower opening 12. The function of the internal terminal 20 and the lower opening 12 of the tube 10 is to conduct electricity when the lower opening 12 is plugged into a corresponding socket.

The upper cap 11 of the tube 10 is made of an insulating material. The upper cap 11 has a top surface and a side surface. A first connecting part 131 is formed at the center of the top surface of the upper cap 11. The first connecting part 131 goes through the upper cap 11 and electrically connects to the internal terminal 20 inside the tube 10. A second connecting part 132 is formed on the outer wall of the tube 10 near the upper cap 11.

In this embodiment, the second connecting part 132 is a soldering surface 133, which is coaxial with the first connecting part 131 and adjacently formed with the first connecting part 131 on the outer wall of the tube 10. It should be noted that in this embodiment, the soldering surface 133 is a cathode and the internal terminal 20 is an anode.

The filter 30 has two electrodes as a first electrode terminal 31 and a second electrode terminal 32 respectively. The length of the first electrode terminal 31 is smaller than the length of the second electrode terminal 32. The first electrode terminal 31 electrically connects to the first connecting part 131. The second electrode terminal 32 electrically connects to the soldering surface 133 on the second connecting part 132.

The filter 30 in this embodiment is a capacitor with the function of storing electrical charges and charging/discharging the charges. When an input voltage is higher than the voltage of the capacitor, the capacitor is charged. When the input voltage drops to lower than the voltage of the capacitor, the capacitor discharges to reduce the voltage drop, thereby reducing variations in the output voltage. This achieves the effect of stabilizing the voltage.

In practice, the invention can be integrally formed with a plastic sleeve for protecting the DC connector. Since the formation temperature of the plastic is relatively high, the capacitor in this embodiment is a ceramic capacitor or a tantalum capacitor that is resistant to high temperature.

Figure 3:
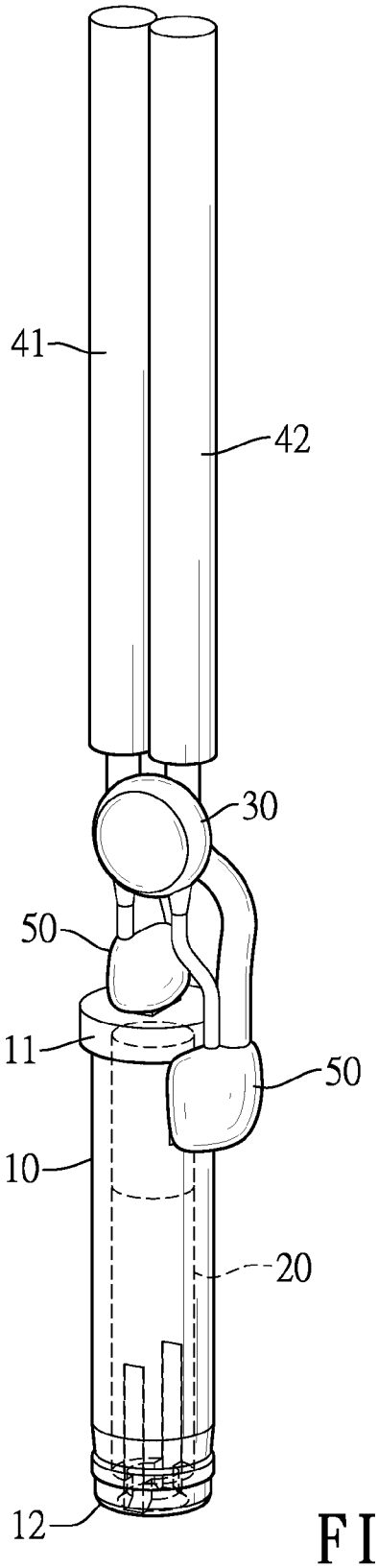
FIG. 3 shows another operational view of the preferred embodiment.

The structure of the invention has been described above. Its application is shown in FIGS. 2 and 3. The first wire 41 has a first core wire 411 inside, and the second wire 42 has a second core wire 421 inside.

The steps for automatic soldering disclosed herein are only an example and should not be used to restrict the invention.

First, the second connecting part 132 is polished to reveal the metal suitable for soldering, thereby forming the soldering surface 133.

The first wire 41 is moved to near the upper end of the tube 10, so that the first core wire 411 passes through the first connecting part 131 on the upper end of the tube 10 and electrically connects to the internal terminal 20. At the same time, the second wire 42 passes through the second connecting part 132, so that the second core wire 421 is mounted across the soldering surface 133. The first electrode terminal 31 and the second electrode terminal 32 of the filter 30 electrically connect to the first connecting part 131 and the soldering surface 133, respectively.

Finally, as shown in FIG. 3, the first core wire 411 and the first electrode terminal 31 are simultaneously in contact with the first connecting part 131 and electrically connect to the internal terminal 20 inside the tube 10. The second core wire 421 and the second electrode terminal 32 are disposed on the soldering surface 133. A metal 50 with a low melting point is used to weld the second core wire 421, the second electrode terminal 32, and the soldering surface 133 together. The first core wire 411, the first electrode terminal 31, and the first connecting part 131 are also welded together. The low melting point metal 50 is soldering tin.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A DC connector with a voltage-stabilizing function, comprising:

a tube, which is a cylindrical tube with an outer surface, an insulated upper cap and a lower opening, the upper cap having a top surface and a side surface, and the upper cap being provided with a first connecting part passed through the upper cap, and the outer surface of the tube near the upper cap being provided with a second connecting part;

a capacitor having two electrode terminals electrically connecting to the first connecting part and the second connecting part respectively; and an internal terminal disposed inside the lower opening of the tube along an axial direction of the tube and electrically connected to the first connecting part.

2. The DC connector with a voltage-stabilizing function as claimed in claim 1, wherein the capacitor is a ceramic capacitor or a tantalum capacitor.

3. The DC connector with a voltage-stabilizing function as claimed in claim 2, wherein the second connecting part has a soldering surface coaxial with the first connecting part and formed adjacent to the first connecting part and on the outer surface of the tube.

4. The DC connector with a voltage-stabilizing function as claimed in claim 3, wherein the two electrode terminals of the capacitor are a first electrode terminal and a second electrode terminal, with the length of the first electrode terminal smaller than the length of the second electrode terminal, the first electrode terminal connecting to the first connecting part, and the second electrode terminal connecting to the second connecting part.

5. The DC connector with a voltage-stabilizing function as claimed in claim 4 further comprising a first wire and a second wire, wherein the first wire has a first core wire and the second wire has a second core wire, the first core wire electrically connects to the internal terminal via the first connecting part, and the second wire passes through the second connecting part.

6. The DC connector with a voltage-stabilizing function as claimed in claim 2, wherein the two electrode terminals of the capacitor are a first electrode terminal and a second electrode terminal, with the length of the first electrode terminal smaller than the length of the second electrode terminal, the first electrode terminal connecting to the first connecting part, and the second electrode terminal connecting to the second connecting part.

7. The DC connector with a voltage-stabilizing function as claimed in claim 6 further comprising a first wire and a second wire, wherein the first wire has a first core wire and the second wire has a second core wire, the first core wire electrically connects to the internal terminal via the first connecting part, and the second wire passes through the second connecting part.

8. The DC connector with a voltage-stabilizing function as claimed in claim 1, wherein the two electrode terminals of the capacitor are a first electrode terminal and a second electrode terminal, with the length of the first electrode terminal smaller than the length of the second electrode terminal, the first electrode terminal connecting to the first connecting part, and the second electrode terminal connecting to the second connecting part.

9. The DC connector with a voltage-stabilizing function as claimed in claim 8 further comprising a first wire and a second wire, wherein the first wire has a first core wire and the second wire has a second core wire, the first core wire electrically connects to the internal terminal via the first connecting part, and the second wire passes through the second connecting part.

10. The DC connector with a voltage-stabilizing function as claimed in claim 9, wherein the second core wire, the second electrode terminal and the soldering surface of the tube are fixed together by welding, and the first core wire, the first electrode terminal, and the first connecting part are also fixed together by welding.

* * * * *